US005251450A

United States Patent [19]

Agrawal et al.

[11] Patent Number: 5,251,450

[45] Date of Patent: Oct. 12, 1993

[54] EFFICIENT SINGLE COLUMN AIR SEPARATION CYCLE AND ITS INTEGRATION WITH GAS TURBINES

[75] Inventors: Rakesh Agrawal, Emmaus; Jianguo Xu, Fogelsville, both of Pa.

[73] Assignee: Air Products and Chemicals, Inc., Allentown, Pa.

[21] Appl. No.: 938,737

[22] Filed: Aug. 28, 1992

[51] Int. Cl.[5] ..... F25J 3/02

[52] U.S. Cl. ..... 62/25; 60/39.12; 62/38

[58] Field of Search ..... 62/25, 38; 60/39.12

[56] References Cited

U.S. PATENT DOCUMENTS

| | | | |
|---|---|---|---|
| 3,210,951 | 10/1965 | Gaumer | 62/29 |
| 4,224,045 | 9/1980 | Olszewski et al. | 62/30 |
| 4,382,366 | 5/1983 | Gaumer | 62/31 |
| 4,464,188 | 8/1984 | Agrawal et al. | 62/13 |
| 4,702,757 | 10/1987 | Kleinberg | 62/24 |
| 4,704,148 | 11/1987 | Kleinberg | 62/24 |
| 4,707,994 | 11/1987 | Shenoy et al. | 62/11 |
| 4,796,431 | 1/1989 | Erickson | 62/31 |
| 4,936,099 | 6/1990 | Woodward et al. | 62/24 |
| 4,947,649 | 8/1990 | Agrawal et al. | 62/11 |
| 5,006,139 | 4/1991 | Agrawal et al. | 62/24 |
| 5,049,173 | 9/1991 | Cormier, Sr. et al. | 62/22 |

FOREIGN PATENT DOCUMENTS 0418139 3/1991 European Pat. Off. .

*Primary Examiner*—Ronald C. Capossela

*Attorney, Agent, or Firm*—Willard Jones, II; William F. Marsh; James C. Simmons

[57] ABSTRACT

The present invention is an improvement to a process for the cryogenic distillation of air to produce both nitrogen and oxygen products carried out in a single distillation column system wherein a feed air stream is distilled thereby producing a nitrogen overhead and a liquid oxygen bottoms. The improvement is characterized in that: (a) operating the single distillation column at a pressure between 70 and 300 psia [480 and 2,070 kPa$_{(absolute)}$]; (b) withdrawing a portion of the liquid oxygen bottoms having an oxygen concentration greater than 80% oxygen and preferably between 85% and 97% oxygen from the bottom of the single distillation column and reducing the pressure of and vaporizing the withdrawn liquid oxygen by heat exchange against a condensing nitrogen stream removed from a top section of the single distillation column; (c) feeding the condensed, nitrogen stream to a top section of the single distillation column as reflux; and (d) recovering the vaporized oxygen as at least a substantial portion of the oxygen product. The improvement can be further characterized by providing boilup by boiling at least another portion of the liquid oxygen bottoms by heat exchange against a condensing vapor stream, wherein the vapor stream to be condensed in an air stream at a higher pressure than the feed air stream or a recycle nitrogen stream at a pressure greater than the operating pressure of the single distillation column, or by recycling a portion of the oxygen product at a pressure of at least the operating pressure of the single distillation column to the bottom of the distillation column and/or by providing intermediate boilup to the stripping section of the single distillation column system by vaporizing a portion of descending column liquid by heat exchange against another condensing vapor stream, wherein the other vapor stream to be condensed is either an air stream at a higher pressure than the feed air stream or a recycle nitrogen stream at a pressure greater than the operating pressure of the single distillation column.

14 Claims, 7 Drawing Sheets

EFFICIENT SINGLE COLUMN AIR SEPARATION CYCLE AND ITS INTEGRATION WITH GAS TURBINES

TECHNICAL FIELD

The present invention is related to single column cryogenic distillation processes for the separation of air and the integration of those processes with gas turbines.

BACKGROUND OF THE INVENTION

In certain circumstances, such as in oxygen-blown gasification-gas turbine power generation processes (e.g., coal plus oxygen derived fuel gas feeding the humidified air turbine cycle or the gas turbine-steam turbine combined cycle) or in processes for steel making by the direct reduction of iron ore (e.g., the COREX TM process) where the export gas is used for power generation, both oxygen and pressurized nitrogen products can be required. This need for pressurized products makes it beneficial to run the air separation unit which produces the nitrogen and oxygen at an elevated pressure. At elevated operating pressures of the air separation unit, the sizes of heat exchangers, pipelines and the volumetric flows of the vapor in the distillation columns decrease, which together reduce the capital cost of the air separation unit. This elevated operating pressure also reduces the power loss due to pressure drops in heat exchangers, pipelines and distillation columns, and brings the operating conditions inside the distillation column closer to equilibrium, so that the air separation unit is more power efficient. Since gasification-gas turbine and direct steel making processes are large oxygen consumers and large nitrogen consumers when the air separation unit is integrated into the base process, better process cycles suitable for elevated pressure operation are required. Numerous single column distillation processes which are known in the art have been offered as a solution to this requirement, among these are the following.

U.S. Pat. No. 4,947,649 discloses a single column air separation process with both air and nitrogen condensing at the bottom of the column to provide column boilup. The disclosed process produces pressurized nitrogen and oxygen at a lower capital cost than a conventional double column system.

U.S. Pat. No. 4,464,188 discloses the use of two reboilers, one at the bottom of the column and the other at an intermediate position, for the production of pressurized nitrogen. The bottom product is considered as waste, or low purity oxygen (<80%), and is expanded to provide refrigeration.

U.S. Pat. No. 4,707,994 discloses a single column air separation cycle with pressurized air condensing in the bottom reboiler to provide column reboil and the liquid air vaporizing in the top condenser to provide column reflux. The vaporized air is then cold compressed before being fed into the middle of the column for distillation.

U.S. Pat. No. 4,382,366 discloses a single column air separation cycle with pressurized air condensing in the reboiler to provide column reboil. The produced liquid air is fed to the top of the column as the sole reflux. This distillation system produces a stream of oxygen and a stream of oxygen-lean air. The oxygen lean-air is then used for combustion after it is heated in the main heat exchanger and exhaust gas preheater. Since the combustion takes place under pressure, the flue gas is used to drive a gas turbine.

The above single column air separation processes all produce either a pressurized nitrogen product or an oxygen-lean air product in the case of U.S. Pat. No. 4,382,366, which can be returned to the gas turbine. U.S. Pat. No. 4,464,188 can only produce pressurized nitrogen. All these cycles, however, have certain disadvantages in coproducing pressurized oxygen and nitrogen.

Since the cycle taught by U.S. Pat. No. 4,382,366 recovers less than about 75% of the oxygen in the feed air, the size of main heat exchanger, pipelines and distillation column diameter will be larger than in other cycles. This increase in size translates directly into increased equipment cost. Further, the need to cool and to warm the additional flow required for the production of a fixed amount of oxygen means increased pressure drop losses and more inefficient heat transfer.

The cycle taught by U.S. Pat. No. 4,707,994 uses air as the heat pump medium, in which the air is first condensed in one boiler/condenser and then vaporized in another. Each time a stream is condensed or vaporized, an inefficiency is introduced into the process due to the temperature difference required for heat transfer in the reboiler and condenser. Further, cold compression which introduces heat into the process at low temperatures further introduces inefficiency.

U.S. Pat. No. 4,464,188 teaches a process which preferably produces an oxygen product at a purities of 80% or less oxygen. Therefore, the process may be inappropriate for many oxygen and nitrogen co-production requirements.

The cycle taught by U.S. Pat. No. 4,947,649 places all the reboiling duty at the bottom which makes the cycle less efficient when operated at very high column pressures due to increased nitrogen recycle flow.

In addition to the above single column distillation processes, numerous double column distillation processes which are known in the art have been offered as a solution to this requirement, among these are the following.

U.S. Pat. No. 3,210,951 discloses a dual reboiler process cycle in which a fraction of the feed air is condensed to provide reboil for the lower pressure column bottom. The condensed feed air is then used as impure reflux for the lower pressure and/or higher pressure column. The refrigeration for the top condenser of the higher pressure column is provided by the vaporazation of an intermediate liquid stream in the lower pressure column.

U.S. Pat. No. 4,702,757 discloses a dual reboiler process in which a significant fraction of the feed air is partially condensed to provide reboil for the lower pressure column bottom. The partially condensed air is then directly fed to the higher pressure column. The refrigeration for the top condenser of the higher pressure column is also provided by the vaporization of an intermediate liquid stream in the lower pressure column.

U.S. Pat. No. 4,796,431 discloses a process with three reboilers located in the lower pressure column. Also, U.S. Pat. No. 4,796,431 suggests that a fraction of the nitrogen removed from the top of the higher pressure column is expanded to a medium pressure and then condensed against the vaporization of a fraction of the bottoms liquid from the higher pressure column (crude liquid oxygen). This heat exchange will further reduce the irreversibilities in the lower pressure column.

U.S. Pat. No. 4,936,099 also discloses a triple reboiler process. In this air separation process, the crude liquid oxygen bottoms from the bottom of the higher pressure column is vaporized at a medium pressure against condensing nitrogen from the top of the higher pressure column, and the resultant medium pressure oxygen-enriched air is then expanded through an expander into the lower pressure column.

Unfortunately, the above cycles are only suitable for operation at low column operating pressures. As column pressure increases, the relative volatility between oxygen and nitrogen becomes smaller so more liquid nitrogen reflux is needed to achieve a reasonable recovery and substantial purity of the nitrogen product. The operating efficiency of the lower pressure column of the above cycles starts to decline as the operating pressure increases beyond about 25 psia.

U.S. Pat. No. 4,224,045 discloses an integration of the conventional double column cycle air separation unit with a gas turbine. By simply taking a well known Linde double column system and increasing its pressure of operation, this patent is unable to fully exploit the opportunity presented by the product demand for both oxygen and nitrogen at high pressures.

Published European Patent Application No. 0,418,139 discloses the use of air as the heat transfer medium to avoid the direct heat link between the bottom end of the upper column and the top end of the lower column, which was claimed by U.S. Pat. No. 4,224,045 for its integration with a gas turbine. However, condensing and vaporizing air not only increase the heat transfer area of the reboiler/condenser and the control cost, but also introduces extra inefficiencies due to the extra step of heat transfer, which makes its performance even worse than the Linde double column cycle.

U.S. Pat. application Ser. No. 07/700,021, issued as U.S. Pat. No. 5,165,245 discloses how the pressure energy contained in the pressurized nitrogen (or waste) streams can be efficiently utilized to make liquid nitrogen and/or liquid oxygen.

SUMMARY OF THE INVENTION

The present invention is an improvement to a process for the cryogenic distillation of air to produce both nitrogen and oxygen products, wherein the cryogenic distillation is carried out in a single distillation column; wherein a feed air stream is compressed, essentially freed of impurities which freeze out at cryogenic temperatures, cooled and fed to the single distillation column thereby producing a nitrogen overhead and a liquid oxygen bottoms.

The improvement is characterized by: (a) operating the single distillation column at a pressure between 70 and 300 psia [480 and 2,070 kPa$_{(absolute)}$]; (b) withdrawing a portion of the liquid oxygen bottoms having an oxygen concentration greater than 80% oxygen and preferably between 85% and 97% oxygen, from the bottom of the single distillation column and reducing the pressure of and vaporizing the withdrawn liquid oxygen by heat exchange against a condensing nitrogen stream removed from a top section of the single distillation column; (c) feeding the condensed, nitrogen stream to a top section of the single distillation column as reflux; and (d) recovering the vaporized oxygen as at least a substantial portion of the oxygen product.

The improvement can be further characterized by providing boilup for the single distillation column by boiling at least another portion of the liquid oxygen bottoms by heat exchange against a condensing vapor stream, wherein the vapor stream to be condensed is an air stream at a higher pressure than the feed air stream or a recycle nitrogen stream at a pressure greater than the operating pressure of the single distillation column, or by feeding a portion of the oxygen product, at a pressure of at least the operating pressure of the single distillation column, to the bottom of the single distillation column.

The improvement can be still further characterized by providing intermediate boilup to the stripping section of the single distillation column system by vaporizing a portion of descending column liquid by heat exchange against another condensing vapor stream, wherein the other vapor stream to be condensed is either an air stream at a higher pressure than the feed air stream or a recycle nitrogen stream at a pressure greater than the operating pressure of the single distillation column.

The preferred embodiment of the present invention uses an air stream at a higher pressure than the feed air stream as the condensing vapor stream boiling the liquid oxygen bottoms and a recycle nitrogen stream at a pressure greater than the operating pressure of the single distillation column as the condensing vapor stream providing the intermediate boilup of the single distillation column. Further, both the condensed recycle nitrogen and the condensed higher pressure air to the single distillation column are fed to the single distillation column in order to provide additional column reflux.

The process of the present invention is particularly suited to integration with a gas turbine system. In such a system, air is compressed in a compressor which is mechanically linked to a gas turbine and which further comprises compressing at least a portion of the gaseous nitrogen produced from the process for the cryogenic distillation of air; mixing the compressed, gaseous nitrogen, at least a portion of the compressed air and a fuel in a combustor thereby producing a combustion gas; work expanding the combustion gas in the gas turbine; and using at least a portion of the work generated to drive the compressor mechanically linked to the gas turbine. In a fully integrated system, at least a portion of the compressed feed air is derived from the air which has been compressed in the compressor which is mechanically linked to the gas turbine.

DETAILED DESCRIPTION OF THE INVENTION

The present invention is an improvement to a single column, cryogenic, air separation process. The improvement, which results in increased energy efficiency, comprises the steps of (a) operating the single distillation column at a pressure between 70 and 300 psia [480 and 2,070 kPa$_{(absolute)}$]; (b) withdrawing a portion of the liquid oxygen bottoms having an oxygen concentration greater than 80% oxygen and preferably between 85% and 97% oxygen from the bottom of the single distillation column and reducing the pressure of and vaporizing the withdrawn liquid nitrogen by heat exchange against a condensing nitrogen stream removed from a top section of the single distillation column; (c) feeding the condensed, nitrogen stream to a top section of the single distillation column as reflux; and (d) recovering the vaporized oxygen as at least a substantial portion of the oxygen product.

To enhance the energy efficiency of the improvement of the present invention, the improvement can further comprise the inclusion of multiple boiler/condensers, wherein one of the boiler/condensers is located in the bottom of the column and at least one other boiler/condenser is located at an intermediate position in the stripping section of the column. In one of these boiler/condensers, the heat source is provided by the condensation of high pressure air; the high pressure air is a fraction of the feed air which has been further compressed. In the other boiler/condenser(s), the heat source is provided by recycled oxygen or the condensation of the recycled nitrogen or the feed air. In the situation where oxygen is recycled, no explicit boiler/condenser is needed. Instead, recycle oxygen would be fed to the bottom of the column in the form of oxygen vapor, thereby realizing the same effect as a reboiler at the bottom.

To better understand the breath of the present invention, specific embodiments are illustrated in FIGS. 1-5. In FIGS. 1-5, all common process elements and streams are identified using the same identifying numbers.

Figure 1:
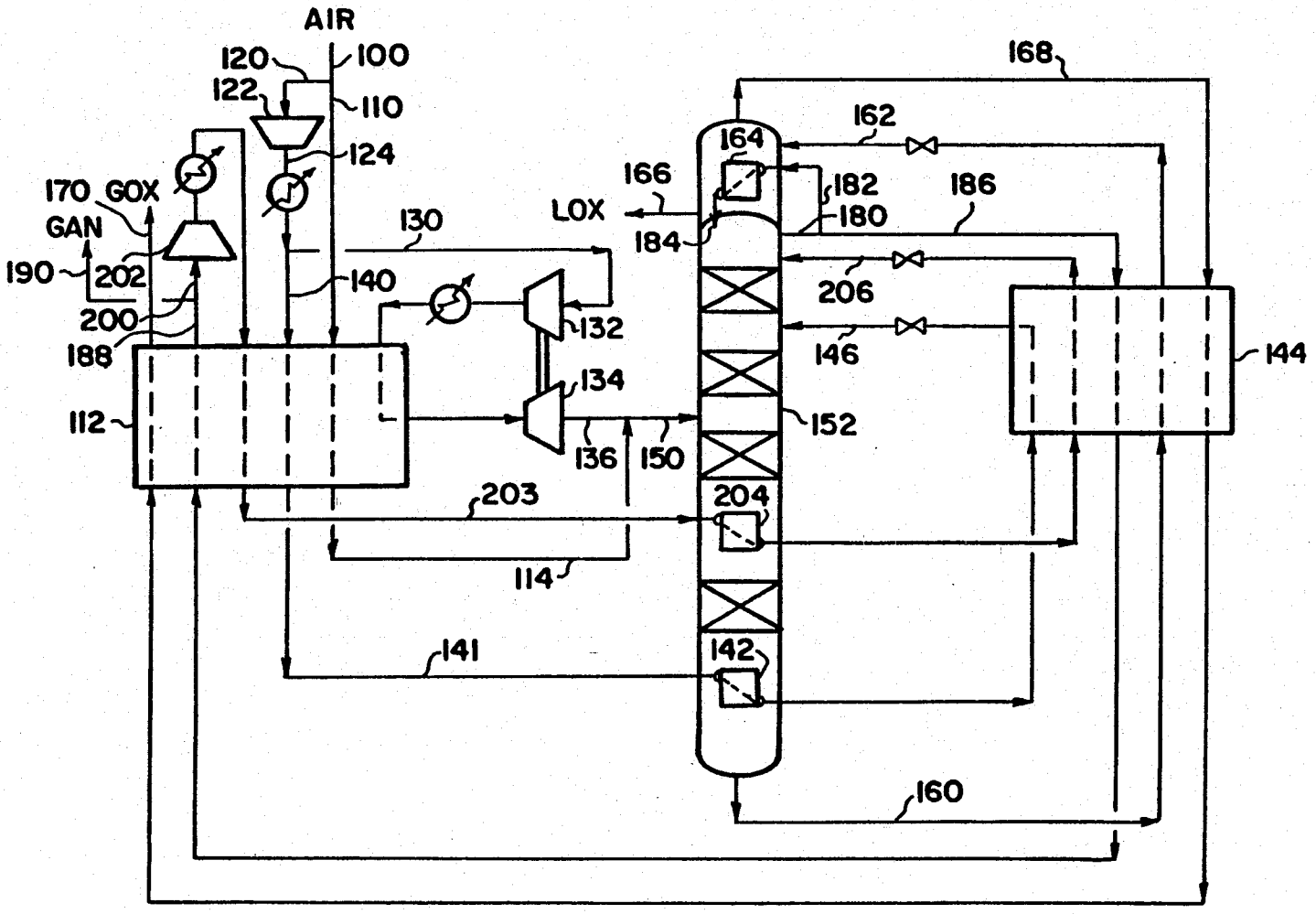
FIGS. 1-5 are schematic diagrams illustrating several embodiments of the process of the present invention.

With reference to the embodiment of the present invention process depicted in FIG. 1, a compressed feed air stream, in line 100, wherein the compressed feed air stream is free of water, carbon dioxide and other impurities which freeze out at cryogenic temperatures and at a pressure of at least 70 psia [480 $kPa_{(absolute)}$], is split into two substreams. The first substream, in line 110, is cooled to near its dew point in main heat exchanger 112. The second substream, in line 120, is further compressed in compressor 122, aftercooled to remove the heat of compression and then split into two portions. The first portion, in line 130, is compressed in compressor 132, cooled in main heat exchanger 112 and expanded in work expander 134. The work generated by work expander 134 is used to drive compressor 132. The cooled, expanded first portion, now in line 136, is combined with the cooled first substream, now in line 114, and fed to an intermediate location of distillation column 152, via line 150. The second portion, in line 140, is cooled in main heat exchanger 112, condensed in boiler/condenser 142 which is located in the bottom of distillation column 152, subcooled in heat exchanger 144, reduced in pressure and fed, via line 146, to distillation column 152 as impure liquid reflux at a location which is higher in the column than the place where the feed air, in line 150, is introduced.

In distillation column 152, the feed air is distilled into a nitrogen overhead and a liquid oxygen bottoms. The liquid oxygen bottoms is removed, via line 160, from distillation column 152, subcooled in heat exchanger 144, reduced in pressure and fed, via line 162, to the sump surrounding boiler/condenser 164. In boiler/condenser 164, the reduced pressure, subcooled, liquid oxygen is vaporized in heat exchange against condensing nitrogen vapor from the top of distillation column 152. The vaporized oxygen product is removed, via line 168, warmed in heat exchangers 144 and 112 to recover refrigeration, and recovered as gaseous oxygen product, via line 170. In addition and if needed, a liquid oxygen product can be recovered by removing liquid, via line 166, from the sump surrounding boiler/condenser 164.

The nitrogen overhead produced in distillation column 152 is removed, via line 180, and split into two parts. The first part, in line 182, is condensed in boiler/condenser 164 in heat exchange against vaporizing liquid oxygen and the condensed nitrogen is returned, via line 184, to distillation column 152 as pure reflux. The second part, in line 186, is warmed in heat exchangers 144 and 112 to recover refrigeration and then split into a gaseous nitrogen product stream and a recycle nitrogen stream. The gaseous nitrogen product is recovered via line 190. The recycle nitrogen stream, in line 200, is compressed in booster compressor 202, cooled in heat exchanger 112, condensed in boiler/condenser 204 which is located in an intermediate location of the stripping section of distillation column 152, subcooled in heat exchanger 144, reduced in pressure and fed, via line 206, to the top of distillation column 152 as additional reflux.

The above embodiment shows boiler/condenser 142 and boiler/condenser 204 being separated by a section of distillation stages. Although this is the preferred mode of operation and configuration, the process will work if both boiler/condensers are located in the bottom of the column without distillation stages between them.

Although not shown on the flowsheet of FIG. 1, gaseous oxygen may be withdrawn from the bottom of distillation column 152, above boiler/condenser 142, as a higher pressure oxygen product. In this case, the amount of liquid oxygen removed, via line 160, will decrease.

As an alternative, it is also possible to exchange the fluids being condensed in the boiler/condensers located in the bottom section of the distillation column in FIG. 1. In such a case, the cooled, high pressure air, in line 141, would be condensed in intermediate boiler/condenser 204, while the recycle nitrogen stream, in line 203, would be condensed in bottom boiler/condenser 142. When exchanging the fluid condensed in each boiler/condenser as compared to the depiction of FIG. 1, the pressure of the high pressure air, in line 141, would decrease and the pressure of the recycle nitrogen stream, in line 203, would increase.

In the process depicted in FIG. 1 and any of the subsequent figures, if needed, either gaseous oxygen and/or nitrogen product streams can be further compressed prior to their end use(s).

Figure 2:
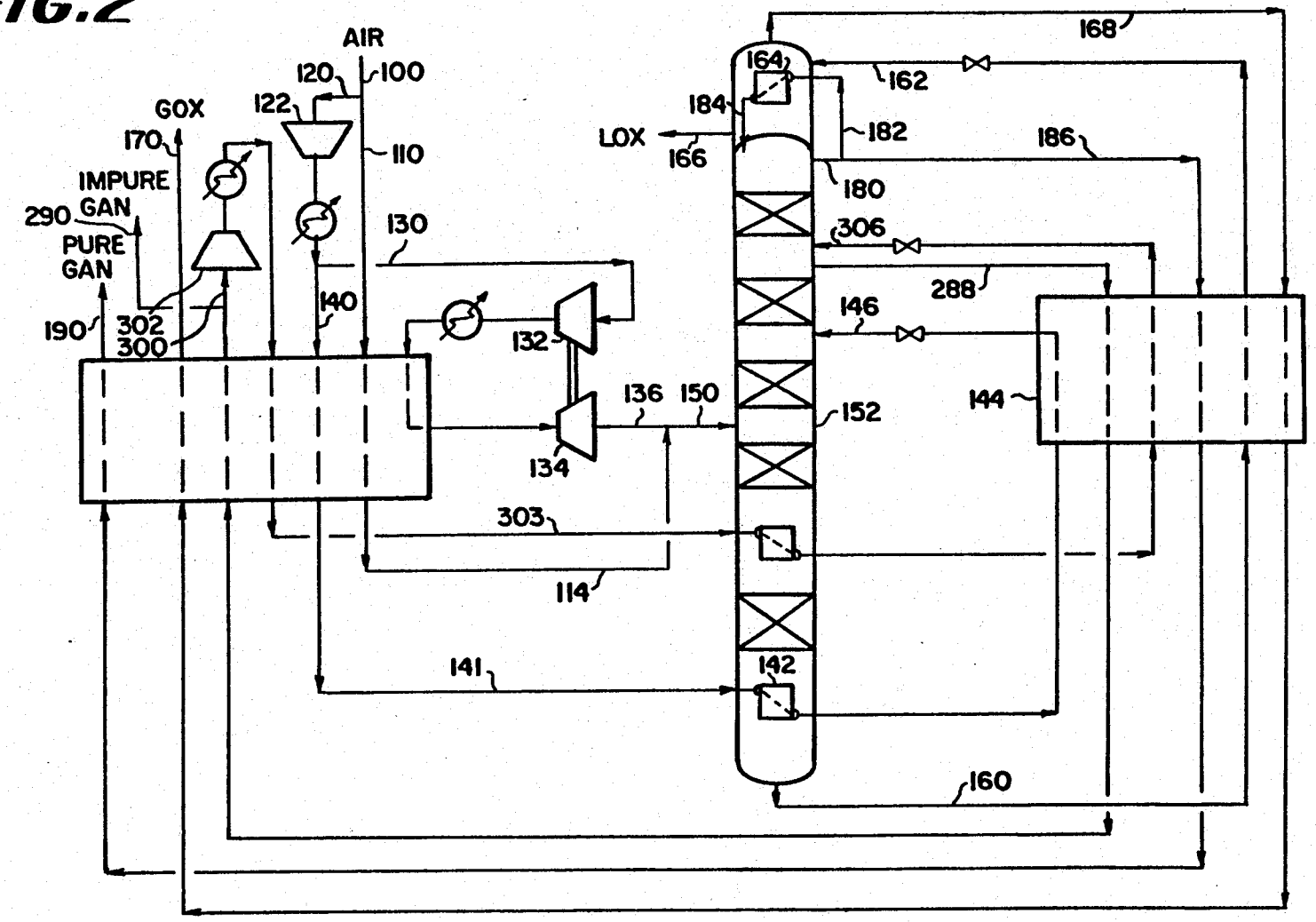

FIG. 2 illustrates a variation of the embodiment of FIG. 1. In the FIG. 2 embodiment, two gaseous nitrogen streams are withdrawn. The smaller and first nitrogen stream of extremely pure nitrogen containing less than 5 vppm oxygen is withdrawn, via line 180, from the top of distillation column 152, and split into two parts. The first part is fed to boiler/condenser 164, via line 182, for condensation, and the second part, in line 186, warmed to recover refrigeration and recovered, via line 190, as a pure gaseous nitrogen product. The larger and second nitrogen stream, having a nitrogen concentration greater than about 95%, is removed, via line 288, from distillation column 152 at a location a few separation stages below the top of the column, warmed and split into two substreams. The first substream, in line 290 is recovered as impure gaseous nitrogen product. The second substream is compressed in booster compressor 302, condensed in boiler/condenser 204, subcooled in heat exchanger 144 and fed, via line 306, to an upper location of distillation column 152 as impure reflux. This process scheme of FIG. 2 allows the production of an extremely pure nitrogen product stream without increasing the boilup or reflux requirements. All other elements of the process are the same as shown in FIG. 1.

Figure 3:
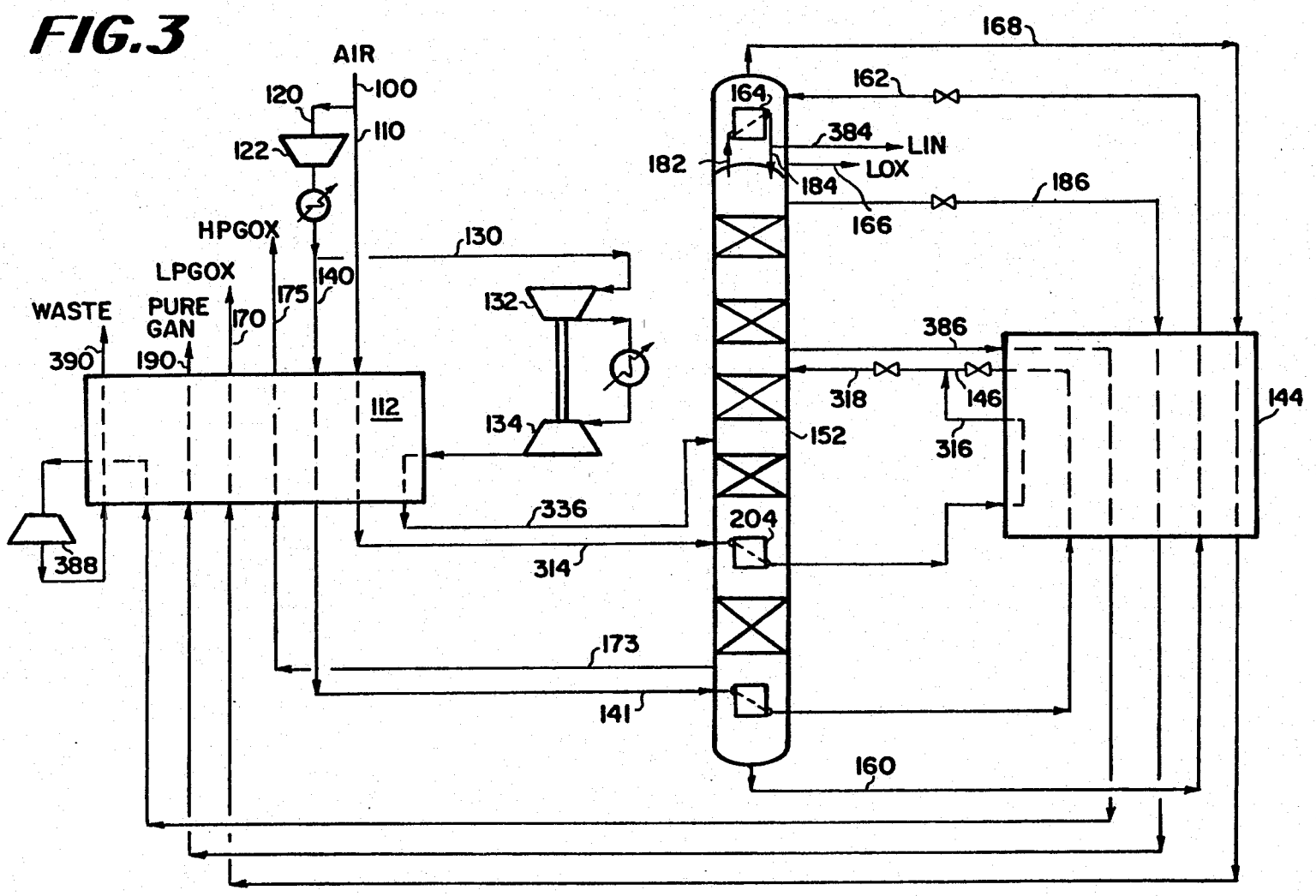

The cycle shown in FIG. 3 allows the production of liquid products. There is no recycle nitrogen loop in this embodiment. With reference to FIG. 3, the feed air, in line 100, is split into two substreams. The first substream is cooled in main heat exchanger 112, condensed in boiler/condenser 204 and subcooled. The second substream, in line 120, is further compressed in compressor 122 and split into two portions. The first portion, in line 130, is still further compressed in compressor 132, expanded in work expander 134, cooled in heat exchanger 112 and fed to an intermediate location of distillation column 152. The second portion, in line 140, is cooled in heat exchanger 112, condensed in boiler/condenser 142, subcooled in heat exchanger 144 and reduced in pressure. This reduced pressure, subcooled second portion, in line 146, is combined with the first substream, in line 316, further reduced in pressure and fed, via line 318, to an intermediate location of distillation column 152 as impure reflux.

In the FIG. 3 embodiment, a portion of the condensed nitrogen overhead from boiler/condenser 164 can be recovered, via line 384, as liquid nitrogen product. High pressure oxygen product is withdrawn from distillation column 153, via line 173, from a location above the bottom reboiler/condenser 142, warmed in heat exchanger 112 and recovered, via line 175, as product. Further, an oxygen-lean waste stream is removed from distillation column 152, via line 386. This removed oxygen-lean waste stream is then warmed in heat exchangers 144 and 112 to recover refrigeration, work expanded in expander 388 to generate refrigeration, further warmed in heat exchanger 112 to recover the generated refrigeration and vented, via line 390. The remaining features of the cycle are the same as described for FIG. 1.

Figure 4:
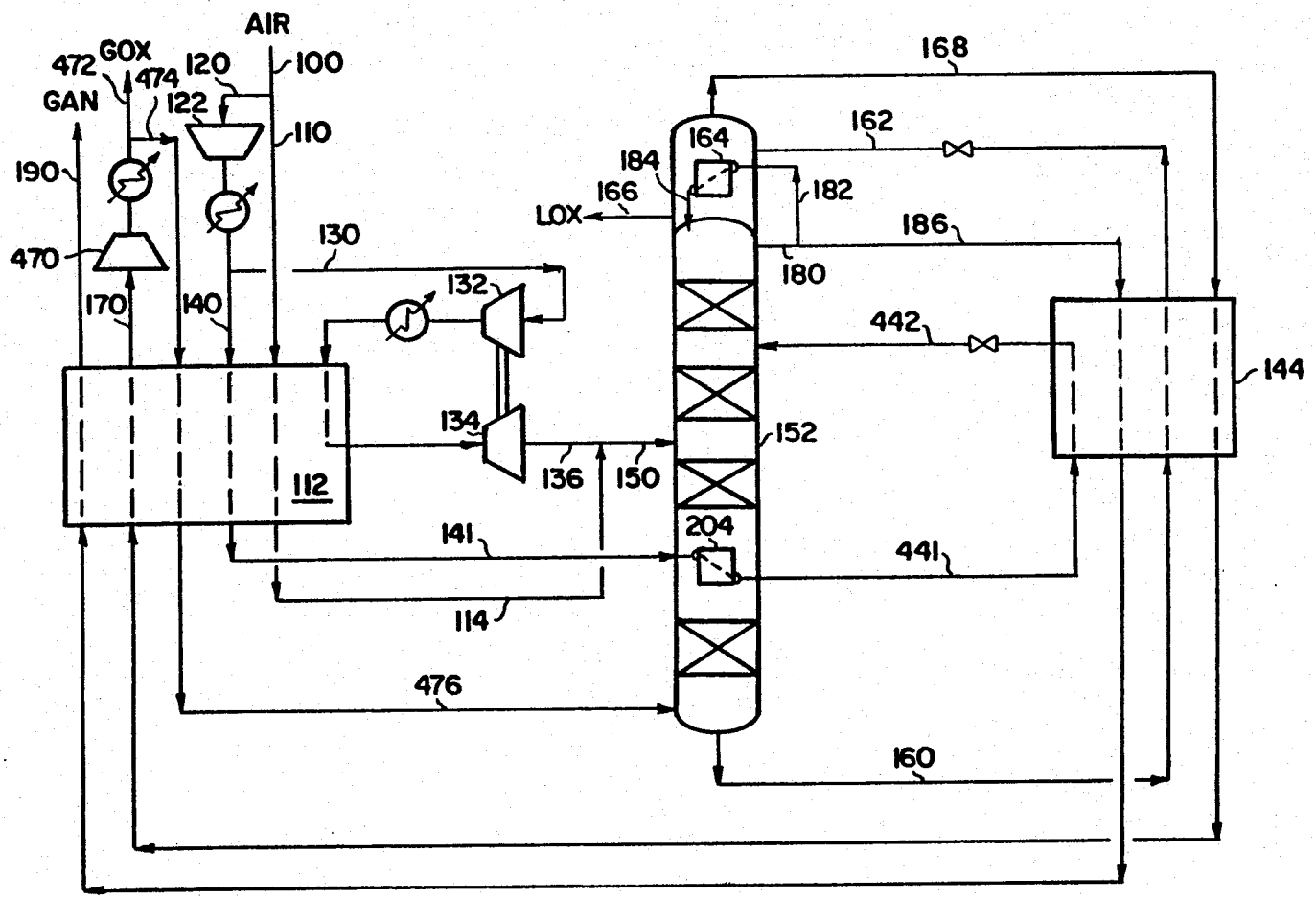

The cycle shown in FIG. 4 has the main features of the cycle of FIG. 1, except as follows. First, oxygen, in line 170, is compressed in compressor 470, and split into a product stream, in line 472, and a recycle stream. The recycle stream, in line 474, is cooled in heat exchanger 112 and fed to the bottom of distillation column 152. Since the recycled oxygen has the same composition as the liquid, it can be introduced as vapor reflux and therefore boiler/condenser 142 is not necessary. The FIG. 4 cycle does not have a nitrogen recycle. Second, high pressure air, in line 141, is condensed in intermediate boiler/condenser 204, subcooled in heat exchanger 144, reduced in pressure and fed, via line 442, to distillation column 152 as impure reflux.

Although all the above cycle embodiments show an intermediate boiler/condenser, it does not mean that these cycles require more than one reboiler to be embodied in the present invention. The other boiler/condenser may be incorporated in the other heat exchangers.

Figure 5:
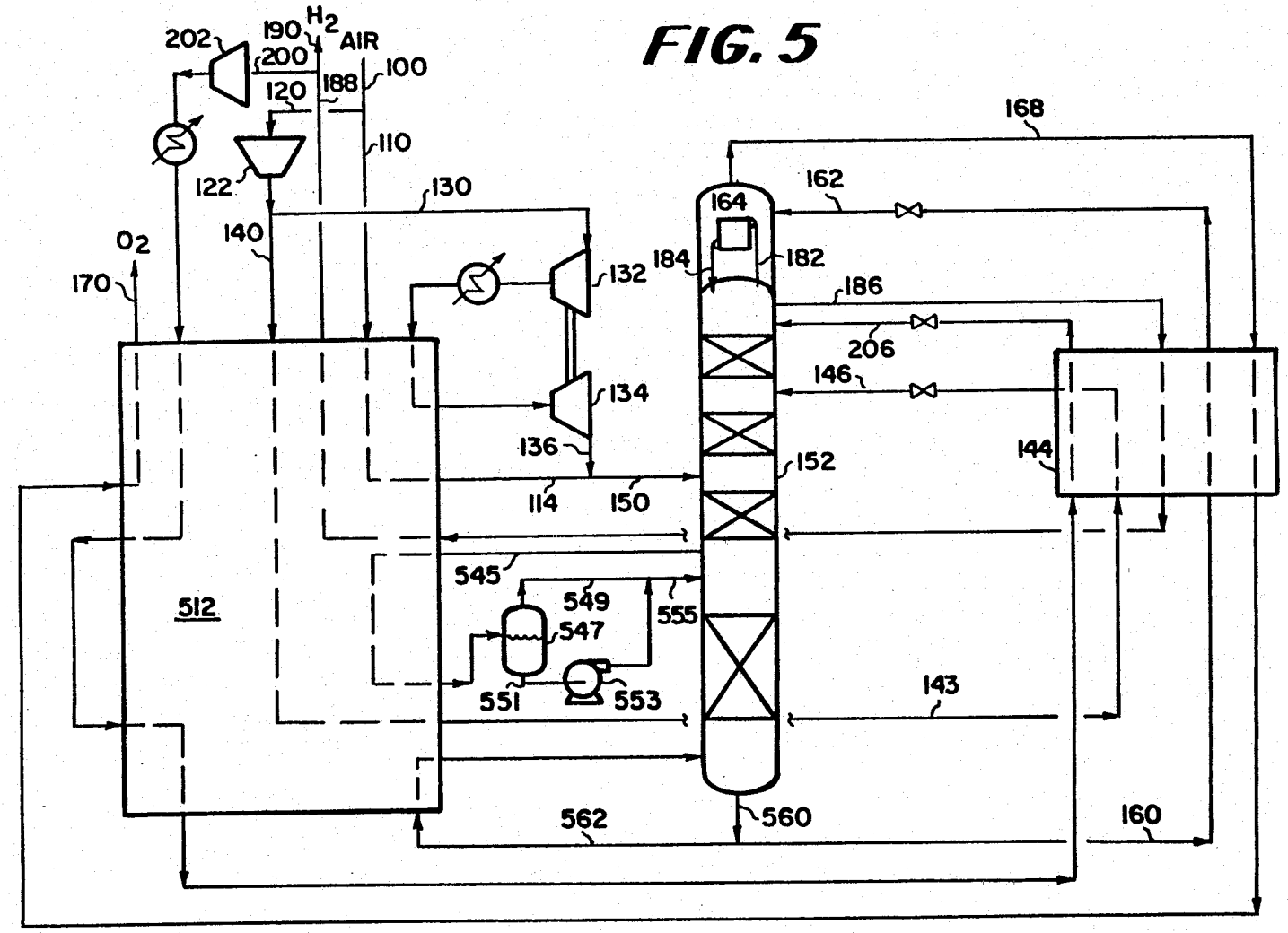

FIG. 5 shows how main heat exchanger 112 and boiler/condenser 142 and 204 of the process of FIG. 1 can be integrated into single heat exchanger core 512. Since the process of the present invention operates at higher pressures, the volumetric flow of gases becomes smaller and heat transfer coefficient becomes greater for the same NTU; (number of transfer unit) thus, the required heat exchanger length is shorter. The same is true for the reboiler/condenser(s). Therefore, it is possible to put all these functions into a "single" heat exchanger core. Note that this single core may actually be a number of cores in parallel. Further note that sections II and III are not necessarily consecutive. In most circumstances it is better to arrange these two sections in parallel, both following section I of the heat exchanger core. The detailed flow is explained below.

With reference to FIG. 5, a compressed feed air stream, in line 100, wherein the compressed feed air stream is free of water, carbon dioxide and other impurities which freeze out at cryogenic temperatures and at a pressure of at least 70 psia [480 $kPa_{(absolute)}$], is split into two substreams. The first substream, in line 110, is cooled to near its dew point in section I of heat exchanger 512. The second substream, in line 120, is further compressed in compressor 122, after cooled to remove the heat of compression and then split into two portions. The first portion, in line 130, is compressed in compressor 132, cooled in section I of heat exchanger 512 and expanded in work expander 134. The work generated by work expander 134 is used to drive compressor 132. The cooled, expanded first portion, now in line 136, is combined with the cooled first substream, now in line 114, and fed to an intermediate location of distillation column 152, via line 150. The second portion, in line 140, is cooled and condensed in section I and II of heat exchanger 512, subcooled in heat exchanger 144, reduced in pressure and fed, via line 146, to distillation column 152 as impure liquid reflux at a location which is higher in the column than the place where the feed air, in line 150, is introduced.

In distillation column 152, the feed air is distilled into a nitrogen overhead and a liquid oxygen bottoms. The liquid oxygen bottoms is removed, via line 560, from distillation column 152 and split into two portions. The first bottoms portion, in line 160, is subcooled in heat exchanger 144, reduced in pressure and fed, via line 162, to the sump surrounding boiler/condenser 164. In boiler/condenser 164, the reduced pressure, subcooled, liquid oxygen is vaporized in heat exchange against condensing nitrogen vapor from the top of distillation column 152. The vaporized oxygen product is removed, via line 168, warmed in heat exchanger 144 and section I of heat exchanger 512 to recover refrigeration, and recovered as gaseous oxygen product, via line 170. The second bottoms portion, in line 562, is vaporized in section III of heat exchanger 512 and fed to the bottom of distillation column 152. Although not shown, in addition and if needed, a liquid oxygen product can be recovered by removing liquid from the sump surrounding boiler/condenser 164.

The nitrogen overhead produced in distillation column 152, is removed in two parts. The first part, in line 182, is condensed in boiler/condenser 164 in heat exchange against vaporizing liquid oxygen and the condensed nitrogen is returned, via line 184, to distillation column 152 as pure reflux. The second part, in line 186, is warmed in heat exchangers 144 and section I of heat exchanger 512 to recover refrigeration and then split into a gaseous nitrogen product stream and a recycle nitrogen stream. The gaseous nitrogen product is recovered via line 190. The recycle nitrogen stream, in line 200, is compressed in booster compressor 202, cooled and condensed in sections I and III of heat exchanger 512, subcooled in heat exchanger 144, reduced in pressure and fed, via line 206, to the top of distillation column 152 as additional reflux.

Finally, intermediate liquid descending distillation column 152 is removed, via line 545, partially vaporized in section II of heat exchanger 512 and phase separated in separator 547. The vapor phase, in line 549, is combined with the liquid phase (line 551) after it has been pumped with pump 553, and the combined stream is returned to distillation column 152, via line 555.

Figure 6:
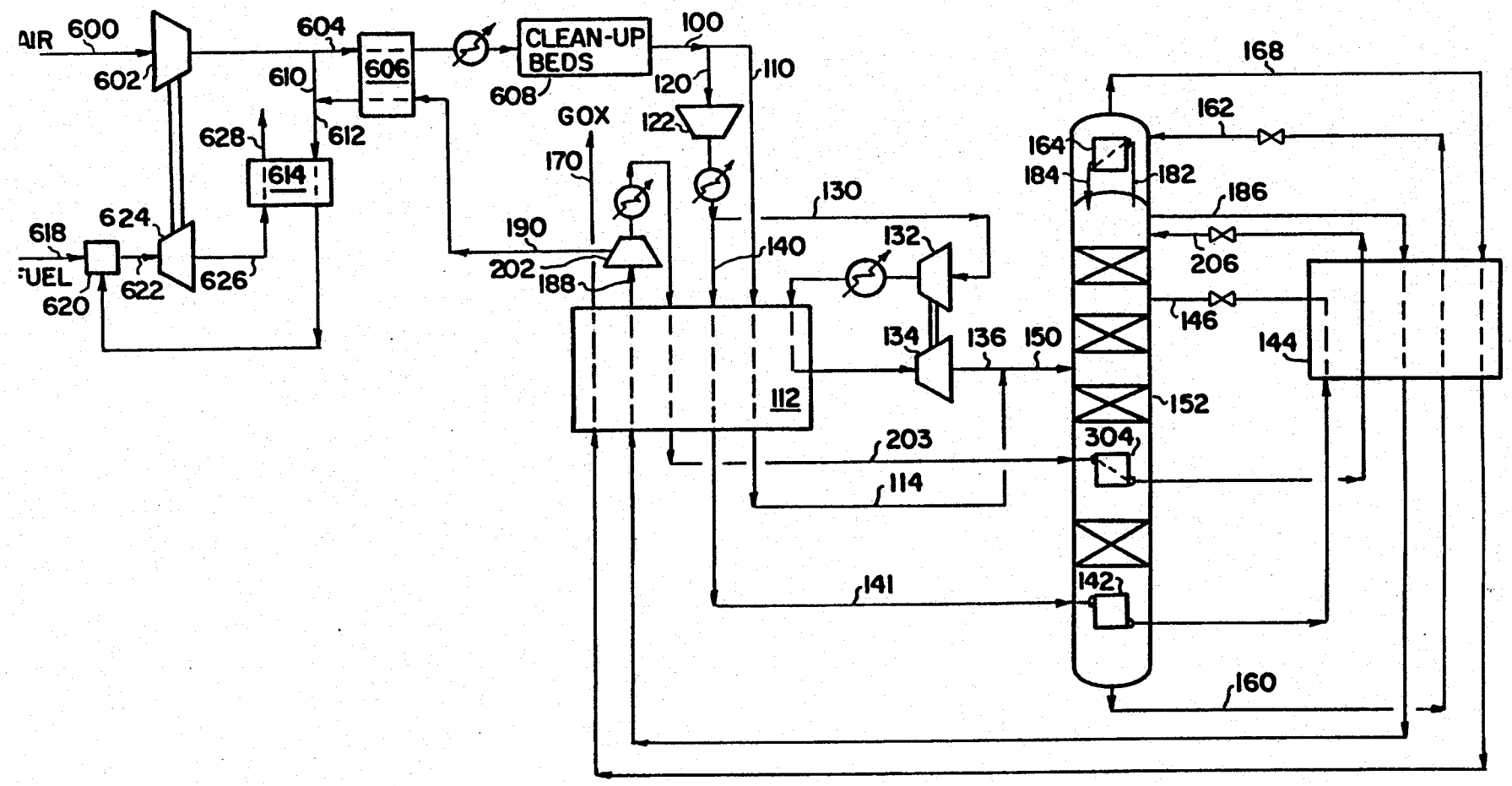
FIG. 6 is a schematic diagram illustrating the integration of an embodiment of the process of the present invention with a gas turbine system.

FIG. 6 illustrates the process of the present invention as depicted in FIG. 1 integrated with a gas turbine system. Since the air separation process embodiment for FIG. 1 has been described above, only the integration will be discussed here. FIG. 6 represents the so-called "fully integrated" option in which all of the feed air to the air separation process is supplied by the compressor mechanically linked to the gas turbine and all of the air separation process gaseous nitrogen product is fed to the gas turbine combustor. Alternatively, "partial integration" options could be used. In these "partial integration" options, part or none of the air separation feed air would come from the compressor mechanically linked to the gas turbine and part or none of the gaseous nitrogen product would be fed to the gas turbine combustor (i.e., where there is a superior alternative for the pressurized nitrogen product) The "fully integrated" embodiment depicted in FIG. 6 is only one example.

With reference to FIG. 6, feed air is fed to the process via line 600, compressed in compressor 602 and split into air separation unit and combustion air portions, in line 604 and 610, respectively. The air separation unit portion is cooled in heat exchanger 606, cleaned of impurities which would freeze out at cryogenic temperatures in mole sieve unit 608 and fed to the air separation unit via line 100. The gaseous nitrogen product from the air separation unit, in line 190, which has been further compressed, is warmed in heat exchanger 606 and combined with the combustion air portion, in line 610. The combined combustion feed air stream, in line 612, is warmed in heat exchanger 614 and mixed with the fuel, in line 618. It should be noted that the nitrogen can be introduced at a number of alternative locations, for example, mixed directly with the fuel gas or fed directly to the combustor. The fuel/combustion feed air stream is combusted in combustor 620 with the combustion gas product being fed to, via line 622, and work expanded in expander 624. FIG. 6 depicts a portion of the work produced in expander 624 as being used to compress the feed air in compressor 602. Nevertheless, all of the remaining work generated can be used for other purposes such as generating electricity. The expander exhaust gas, in line 626, is cooled in heat exchanger 614 and removed via line 628. The cooled, exhaust gas, in line 628, is then used for other purposes, such as generating steam in a combined cycle. Alternatively, the expander exhaust gas can be solely in a combined cycle (i.e., without heat exchange in heat exchanger 614, as indicated), which is the conventional gas turbine/steam turbine combined cycle arrangement; this detail is not important for the key single column concept. It should also be mentioned here that both nitrogen and air (as well as fuel gas) can be loaded with water to recover low level heat before being injected into the combustor. Such cycles will not be discussed in detail here.

The increased efficiency of the single column air separation system of the present invention results from the judicious use of the condenser at the top of the column and multiple reboilers in the column. The heat pump recycle flow is reduced by realizing that by boiling liquid oxygen in the top boiler/condenser, liquid nitrogen reflux needs of the column can be supplemented. This reduction in heat pump recycle flow reduces the inefficiencies such as pressure drop and heat exchanger losses associated with the recycle flow. By using intermediate boiler/condenser(s) plus a bottom boiler/condenser, the power consumption of air separation can be reduced due to the fact that the operating line in the lower section of the column is closer to the equilibrium curve, which reduces the inefficiency of the distillation column. Furthermore, the flow of the heat pump recycle is reduced by using a portion of the feed air to provide the boilup.

Since the single column system operates at an elevated pressure, all the nitrogen gas streams in the system have pressures of greater than 60 psia [413 $kPa_{(absolute)}$], the sizes of heat exchangers and pipelines become smaller. The embodiments of the present invention keep the advantages of the single column system, smaller heat exchangers, pipelines and distillation column, or in general, smaller cold box, as well as simple control loop and other auxiliary equipment and instrumentation of the column. Due to these advantages, it is preferred to the conventional double column system when both pressurized nitrogen and oxygen products are demanded by the customer. That is especially true for the integration of the air separation unit with a gas turbine as in oxygen-blown gasification-gas turbine power generation processes (e.g., coal plus oxygen derived fuel gas feeding the humidified air turbine cycle or the gas turbine-steam turbine combined cycle) or in processes for steel making by the direct reduction of iron ore (e.g., the COREX TM process) where the export gas is used for power generation.

As was mentioned above, when pressurized nitrogen and oxygen and/or liquid products are demanded by the customer, it can be better to work with a single column than the conventional double column system due to the reduced sizes of pipelines, total volume of the distillation column and the size of the cold box, as well as the simpler control loop for the column system. The power consumption of these cycles is equal to or lower than the conventional double column cycles, therefore, these cycles are more advantageous.

EXAMPLE

To demonstrate the efficacy of the present invention, two cycles, that of FIG. 1 of the present invention and a conventional double column cycle were simulated at the following conditions: a feed air at 147 psia [1,015 $kPa_{(absolute)}$] and 55° F. [12.8° C.], an NTU of 52 in the main heat exchanger and oxygen product purities of 90% and 95% oxygen. The important parameters of the simulation results are shown in the following tables.

Figure 7:
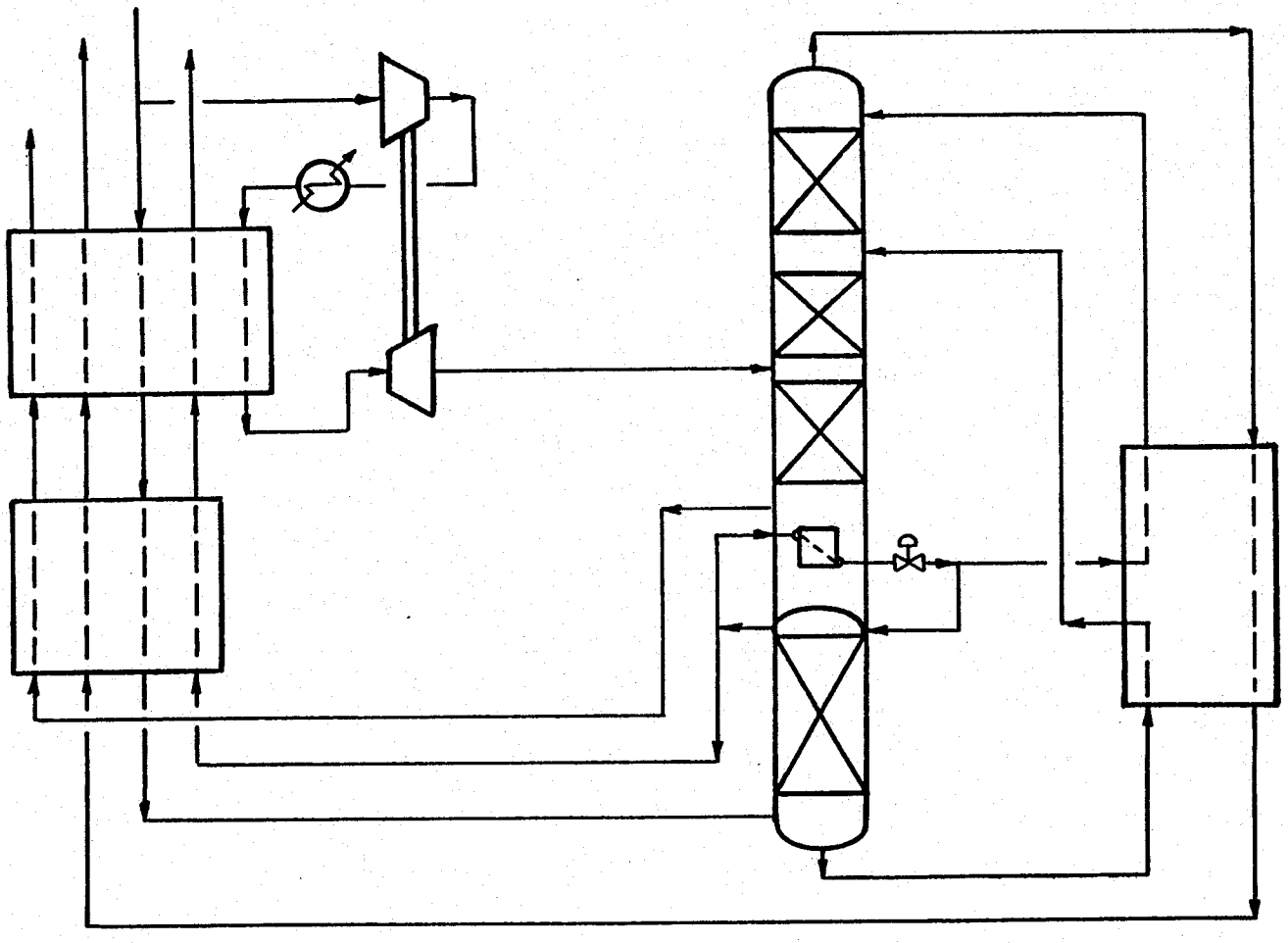
FIG. 7 PRIOR ART
FIG. 7 is a schematic of a conventional double column distillation process.

| Cycle | $O_2$ Purity: % | No. of Stages | $O_2$ Rec. | HP Air (stream 124) F: % | HP Air (stream 124) P: psia [kPa] | Nitrogen Recycle (stream 203) F: % | Nitrogen Recycle (stream 203) P: psia [kPa] | Rel. Power |
|---|---|---|---|---|---|---|---|---|
| Process of the Present Invention (FIG. 1) | 90 | 70 | 20.27 | 38.21 | 297 [2048] | 60 | 275 [1896] | .966 |
| Conventional Double Column Process (FIG. 7) | 90 | HP: 45 LP: 35 | 20.29 | | | | | 1 |
| Process of the Present Invention (FIG. 1) | 95 | 70 | 20.51 | 41.41 | 312 [2151] | 65 | 298 [2054] | .985 |
| Conventional Double Column Process (FIG. 7) | 95 | HP: 45 LP: 35 | 20.42 | | | | | 1 |

LP means the Lower Pressure Column and HP means the Higher Pressure Column of a conventional double column distillation process.

As one can note, the specific powers of the cycle of FIG. 1 are respectively 3.4% and 1.5% lower than those of the conventional double column cycle at oxygen purities of 90% and 95%. The other cycles of the invention may yield different power values and may show their optimal performance at different conditions. This table, however, is presented to illustrate that at certain conditions, some of the cycles of the invention are not only advantageous in terms of investment cost, but also more power efficient than the conventional double column cycle for co-production of pressurized nitrogen and oxygen.

The present invention has been described with reference to several specific embodiments thereof. These embodiments should not be viewed as a limitation of the present invention. The scope of the present invention should be ascertained from the following claims.

We claim:

1. A process for the cryogenic distillation of air to produce both nitrogen and oxygen products, wherein the cryogenic distillation is carried out in a single distillation column; wherein a feed air stream is compressed, essentially freed of impurities which freeze out at cryogenic temperatures, cooled and fed to the single distillation column thereby producing a nitrogen overhead and a liquid oxygen bottoms characterized by:

(a) operating the single distillation column at a pressure between 70 and 300 psia [480 and 2,070 kPa-(absolute)];

(b) withdrawing a portion of the liquid oxygen bottoms having an oxygen concentration greater than 80% oxygen from the bottom of the single distillation column and reducing the pressure of and vaporizing the withdrawn liquid oxygen by heat exchange against a condensing nitrogen stream removed from a top section of the single distillation column;

(c) feeding the condensed, nitrogen stream to a top section of the single distillation column as reflux; and (d) recovering the vaporized oxygen as at least a substantial portion of the oxygen product.

2. The process of claim 1 wherein the oxygen concentration of the liquid oxygen bottoms from the bottom of the single distillation column is between 85% and 97% oxygen.

3. The process of claim 2 wherein air is compressed in a compressor which is mechanically linked to a gas turbine and which further comprises compressing at least a portion of the gaseous nitrogen produced from the process for the cryogenic distillation of air; mixing the compressed, gaseous nitrogen, at least a portion of the compressed air and a fuel in a combustor thereby producing a combustion gas; work expanding the combustion gas in the gas turbine; and using at least a portion of the work generated to drive the compressor mechanically lined to the gas turbine.

4. The process of claim 3 wherein at least a portion of the compressed feed air is derived from the air which has been compressed in the compressor which is mechanically linked to the gas turbine.

5. The process of claim 1 which further comprises providing boilup for the single distillation column by boiling at least another portion of the liquid oxygen bottoms by heat exchange against a condensing vapor steam, wherein the vapor stream to be condensed is an air stream at a higher pressure than the feed air stream or a recycle nitrogen stream at a pressure greater than the operating pressure of the single distillation column, or by feeding a portion of the oxygen product, at a pressure of at least the operating pressure of the single distillation column, to the bottom of the single distillation column.

6. The process of claim 5 wherein air is compressed in a compressor which is mechanically linked to a gas turbine and which further comprises compressing at least a portion of the gaseous nitrogen produced from the process for the cryogenic distillation of air; mixing the compressed, gaseous nitrogen, at least a portion of the compressed air and a fuel in a combustor thereby producing a combustion gas; work expanding the combustion gas in the gas turbine; and using at least a portion of the work generated to drive the compressor mechanically lined to the gas turbine.

7. The process of claim 6 wherein at least a portion of the compressed feed air is derived from the air which has been compressed in the compressor which is mechanically linked to the gas turbine.

8. The process of claim 5 which further comprises providing intermediate boilup to the stripping section of the single distillation column system by vaporizing a portion of descending column liquid by heat exchange against another condensing vapor stream, wherein the other vapor stream to be condensed is either an air stream at a higher pressure than the feed air stream or a recycle nitrogen stream at a pressure greater than the operating pressure of the single distillation column.

9. The process of claim 8 wherein an air stream at a higher pressure than the feed air stream is the condensing vapor stream boiling the liquid oxygen bottoms and a recycle nitrogen stream at a pressure greater than the operating pressure of the single distillation column is the condensing vapor stream providing the intermediate boilup of the single distillation column.

10. The process of claim 9, which further comprises feeding both the condensed recycle nitrogen and the condensed higher pressure air to the single distillation column in order to provide additional column reflux.

11. The process of claim 1 which further comprises further compressing and work expanding a fraction of the compressed feed air to the operating pressure of the single distillation column and feeding the expanded fraction to an intermediate location of the single distillation column.

12. The process of claim 11 wherein the work generated by the work expansion is used to provide at least a portion of the work required to further compress the fraction of the feed air.

13. The process of claim 1 wherein air is compressed in a compressor which is mechanically linked to a gas turbine and which further comprises compressing at least a portion of the gaseous nitrogen produced from the process for the cryogenic distillation of air; mixing the compressed, gaseous nitrogen, at least a portion of the compressed air and a fuel in a combustor thereby producing a combustion gas; work expanding the combustion gas in the gas turbine; and using at least a portion of the work generated to drive the compressor mechanically linked to the gas turbine.

14. The process of claim 13 wherein at least a portion of the compressed feed air is derived from the air which has been compressed in the compressor which is mechanically linked to the gas turbine.

* * * * *